US006237269B1

(12) United States Patent
Key

(10) Patent No.: US 6,237,269 B1
(45) **Date of Patent: *May 29, 2001**

(54) ROLL-FED METHOD FOR CONSTRUCTING A ROTATABLE LABEL SYSTEM

(75) Inventor: Stephen M. Key, Oakdale, CA (US)

(73) Assignee: Stephen Key Design, LLC, Oakdale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/273,232

(22) Filed: Mar. 18, 1999

(51) Int. Cl.[7] ..... G09F 3/10

(52) U.S. Cl. ..... 40/638; 40/306; 40/310; 40/506

(58) Field of Search ..... 40/306, 310, 638, 40/324, 506; 206/459.5; 215/250

(56) References Cited

U.S. PATENT DOCUMENTS

| | | | | |
|---|---|---|---|---|
| 736,035 | | 8/1903 | Stevenson . | |
| 1,054,826 | * | 3/1913 | Cole | 40/310 X |
| 1,064,576 | | 6/1913 | Washburn . | |
| 1,312,611 | | 8/1919 | Chess . | |
| 1,334,031 | | 3/1920 | Hahn . | |
| 1,387,625 | | 8/1921 | Stein . | |
| 1,486,313 | | 3/1924 | Van Antwerp . | |
| 2,013,616 | | 9/1935 | Rettenmeyer | 220/1 |
| 2,129,364 | | 9/1938 | Simons et al. | 283/8 |
| 2,441,607 | | 5/1948 | Walls | 46/13 |
| 2,468,000 | | 4/1949 | Taylor | 273/143 |
| 2,504,076 | | 4/1950 | Lindblom | 40/68 |
| 2,706,464 | | 4/1955 | North | 116/121 |
| 2,739,564 | | 3/1956 | North | 116/121 |
| 2,844,893 | | 7/1958 | Keller | 40/4 |
| 2,860,431 | | 11/1958 | Barnum | 40/61 |
| 2,931,657 | | 4/1960 | Lewis | 273/155 |
| 2,935,814 | | 5/1960 | Freeze | 46/35 |
| 2,971,283 | | 2/1961 | Parker | 40/334 |
| 3,278,182 | | 10/1966 | Lescher | 272/8 |
| 3,374,911 | | 3/1968 | White | 215/8 |
| 3,488,880 | | 1/1970 | Taylor | 46/24 |
| 3,542,229 | | 11/1970 | Beyerlein et al. | 215/1 |
| 3,604,584 | | 9/1971 | Shank | 215/12 R |
| 3,733,002 | | 5/1973 | Fujio | 215/12 R |
| 3,874,977 | * | 4/1975 | Pyles | 40/310 X |

(List continued on next page.)

FOREIGN PATENT DOCUMENTS

| | | | |
|---|---|---|---|
| 85214 | 3/1958 | (DK) . | |
| 0285514 | 10/1988 | (EP) | G09F/3/02 |
| 965522 | 9/1950 | (FR) . | |
| 1114750 | 12/1955 | (FR) . | |
| 1347102 | 11/1963 | (FR) . | |
| 2460260 | 1/1981 | (FR) | B65D/25/36 |
| 2677786 | 12/1992 | (FR) | G09F/3/02 |
| 327286 | 7/1935 | (IT) . | |

*Primary Examiner*—Terry Lee Melius
*Assistant Examiner*—James M Hewitt
(74) *Attorney, Agent, or Firm*—Carr & Ferrell LLP

(57) ABSTRACT

A system and method are disclosed for constructing a rotatable label and attaching the rotatable label to a container. The rotatable label system includes an inner label attached to the container and a rotatable outer label. The inner label may have adhesive on a rear surface of a trailing end alone, or it may have adhesive on a rear surface of both the leading and trailing end for fixedly attaching it to a container. The outer label only has adhesive on a rear surface of a trailing end to secure the outer label to itself. A leading end is temporarily affixed to the container while the outer label is wrapped around the container. Once the trailing end is attached to a front surface of the leading end, the outer label can be rotated about the container over the inner label. Longitudinal movement of the outer label relative to the container may be restricted by disposing the outer label between top and bottom label panels formed on the container. The outer label is preferably adapted with a transparent portion or window permitting viewing of indicia disposed on the inner label.

38 Claims, 15 Drawing Sheets

U.S. PATENT DOCUMENTS

| | | | |
|---|---|---|---|
| 3,960,713 | 6/1976 | Carey | 206/534 |
| 4,044,889 | 8/1977 | Orentreich et al. | 206/459 |
| 4,203,240 | 5/1980 | Goodwin | 40/310 |
| 4,381,615 | 5/1983 | Lonsmin | 40/334 |
| 4,405,045 | 9/1983 | Villa-Real | 206/534 |
| 4,505,497 | 3/1985 | Katzman | 283/81 |
| 4,567,681 | 2/1986 | Fumei | 40/310 |
| 4,658,974 | 4/1987 | Fujita et al. | 215/12 R |
| 4,724,973 | 2/1988 | Shah | 215/246 |
| 4,877,119 | 10/1989 | Hosking | 206/459 |
| 5,076,613 | 12/1991 | Kovacs | 283/106 |
| 5,154,448 | 10/1992 | Griffin et al. | 283/102 |
| 5,324,559 | 6/1994 | Brombacher | 428/40 |
| 5,342,093 | 8/1994 | Weernink | 285/81 |
| 5,403,636 | 4/1995 | Crum | 428/40 |
| 5,484,167 * | 1/1996 | Donaldson et al. | 40/310 X |
| 5,639,529 * | 6/1997 | Gozdecki et al. | 40/310 X |
| 5,809,674 * | 9/1998 | Key | 40/306 |
| 5,884,421 * | 3/1999 | Key | 40/306 |
| 5,953,170 * | 9/1999 | Glancy | 40/310 X |

* cited by examiner 100
102
122
A
A
A
112
116
118
114
120
104

200
202
B
B
B
204
Bottom Label (Front side)

ROLL-FED METHOD FOR CONSTRUCTING A ROTATABLE LABEL SYSTEM

CROSS-REFERENCE TO RELATED PATENTS AND APPLICATIONS

The present application is related to and hereby incorporates by reference the following patents and patent applications: (i) U.S. Pat. No. 5,809,674 issued Sep. 22, 1998 (application Ser. No. 08/627,786, filed Mar. 28, 1996), entitled "Apparatus and Method For Increasing An Effective Information Carrying Surface Area On A Container"; (ii) U.S. Pat. No. 5,884,421 issued Mar. 23, 1999 (application Ser. No. 08/741,607, filed Oct. 31, 1996 entitled "Apparatus and Method for Constructing a Rotatable Label Device"; (iii) U.S. Pat. No. 6,086,697 issued Jul. 11, 2000 (application Ser. No. 09/126,010 filed Jul. 29, 1998), entitled "Rotating Label System and Method"; (iv) U.S. patent application No. 09/187,299 filed Nov. 5, 1998 entitled "Rotatable Label System and Method for Constructing the Same"; and (v) U.S. patent application No. 09/247,245, filed Feb. 9, 1999 entitled "Rotatable label System Including Tamper-Evident Feature And Method For Constructing Same".

BACKGROUND OF THE INVENTION

1. Field of the Invention

The present invention relates generally to labels, and more particularly to a rotatable label system with inner and outer label surfaces, utilizing a minimum amount of adhesives and eliminating tab related mechanisms.

2. Description of the Prior Art

Many consumer products, such as vitamins, medications, and food items, are packaged in containers. It is usually desirable to display information in the form of written indicia arranged on the exterior surface of such containers to inform consumers as to the nature and use of the associated product. This information may include directions for use, warnings, dosage amounts, ingredients, company logos, and advertisements. Such information is conventionally printed on a label affixed to the container.

Prior art labels may have insufficient area available, however, to accommodate all of the information that a manufacturer may desire to provide to the consumer. Of course, the manufacturer may include all of the desired information on the label by reducing the size or typeface of some or all of the indicia, or by closely spacing the indicia. However, reduction of the size of text and/or graphics may adversely affect the visual appeal of the container, or may render some or all of the information illegible to the consumer. Furthermore, consumers may tend to ignore information presented in "fine print."

A manufacturer who wishes to provide a relatively large amount of information to the consumer may also opt to place some of the information on a separate sheet of paper (known as an "insert") packaged with the container. This technique is commonly employed in connection with health care items, such as over-the-counter medications and contact lens solutions. However, the insert is frequently lost or discarded after the initial use of the associated product, thus causing information set forth thereon to become unavailable to the consumer.

Thus, there is a need in the product packaging art for a system for increasing the amount of information that can be presented on a product container. There is a more specific need for a rotatable label system having an augmented surface area for presenting written information, and which is more easily mounted to the container, but without excessive use of adhesives and tab related release mechanisms.

SUMMARY OF THE INVENTION

The present invention relates to a rotatable label system, which utilizes a minimal amount of adhesive and eliminates tab mechanisms. The rotatable label system generally includes a container for holding a quantity of a consumer or other type product, and a label or shell disposed about the exterior of the container and conforming thereto. The invention discloses methods and apparatus, and particularly it discloses a label system for application to a container or other object including an inner label having front and rear surfaces and leading and trailing ends. The invention further discloses an adhesive disposed on the rear surface of the inner label at the trailing end for coupling the inner label to the container or itself. Further, the invention discloses an outer label which includes an adhesive only on a rear surface of a trailing end of the outer label for adhering the trailing end of the outer label to the corresponding front surface of the outer label so that the outer label is secured about the container but rotatable about the inner label.

The method includes providing a container, and providing an inner label and an outer label, each label having front and rear surfaces and leading and trailing ends; providing an adhesive on the rear surface of the inner label for fixedly mounting the inner label to the container; providing an adhesive on the rear surface of the outer label for adhering the leading end of the outer label only to the trailing end of the outer label to allow the outer label to freely rotate around the inner label. Also provided is a transparent portion formed in the outer label so that the written indicia disposed on the front surface of the inner label is viewable through the transparent portion of the outer label.

BRIEF DESCRIPTION OF THE DRAWINGS

For a more complete understanding of the invention, reference may be had to the following detailed description of the invention in conjunction with the drawings wherein.

DETAILED DESCRIPTION OF THE INVENTION

Figures 1, 2:
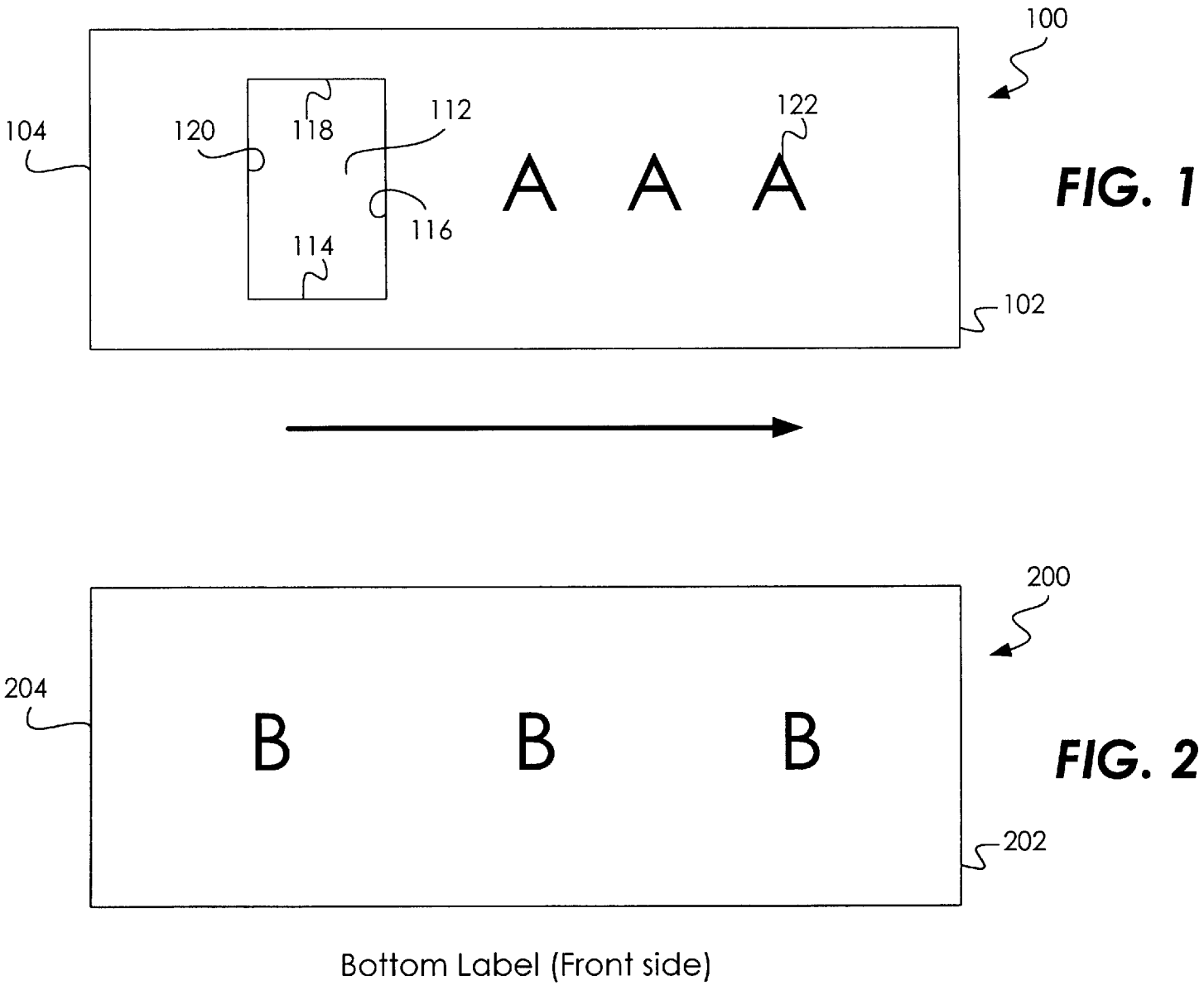
FIG. 1 is a plan view of a front surface of an outer label in accordance with the present invention.
FIG. 2 is a plan view of a front surface of an inner label in accordance with the present invention.

FIG. 1 illustrates a front surface of an outer label or shell 100 according to the principles of the present invention. As shown, the outer label 100 includes a first, leading end 102 and a second, trailing end 104. As was the case in previous embodiments by this inventor, for example, see U.S. Pat. No. 09/126,010, there is no release tab which was used previously to enhance the mounting and deployment of the outer label to the inner label. In the present invention, no such perforated edge or release tab is necessary.

The outer label 100 also includes a transparent portion 112. The transparent portion 112 is illustrated as being defined by edges 114, 116, 118, and 120. The transparent portion 112 may include an open window with no material disposed between edges 114–120; or, alternatively, the transparent portion 112 may comprise a transparent film or the like to permit viewing through the transparent portion 112. As discussed in more detail below, the transparent portion 112 permits an exterior of the underlying container, or underlying label, to be viewed through the outer label 100. FIG. 1 also shows writing or other indicia 122 that may include outer label messages such as trademarks, contents, usage instructions, etc.

The transparent portion 112 permits a user to view an underlying subset of indicia disposed on an inner label affixed to the container 500. The user or consumer selects which subset of indicia he or she wishes to view by rotating the rotatable outer label 100 about a central axis of the container such that the selected subset of indicia appears within the transparent portion 112. As depicted in the figures herein, the written indicia may include several subsets (product information, ingredients, and the like) circumferentially arranged on the inner label, each subset being selectively viewable by the user.

FIG. 2 illustrates a front surface of an inner label 200. The inner label 200 includes a first, leading end 202 and a second, trailing end 204. As can be seen in FIG. 2, the inner label 200 is slightly narrower than the outer label 100 seen in FIG. 1. As will be seen and described in later figures, inner label 200 is more or less fixedly mounted to a container, while outer label 100 is intended to be movably constructed and mounted over the inner label 200. Because of the looser mounting of the top label 100 than the mounting of inner label 200, the narrower width of inner label 200 prevents the inner label 200 from being seen extending out from the edges of the outer label 100. Clearly seen in FIG. 2 is the fact that inner label 200 is shorter than outer label 100, seen in FIG. 1. This is to allow the outer label to be fixed to itself thereby allowing the outer label to rotate about the inner label 200.

Figure 3:
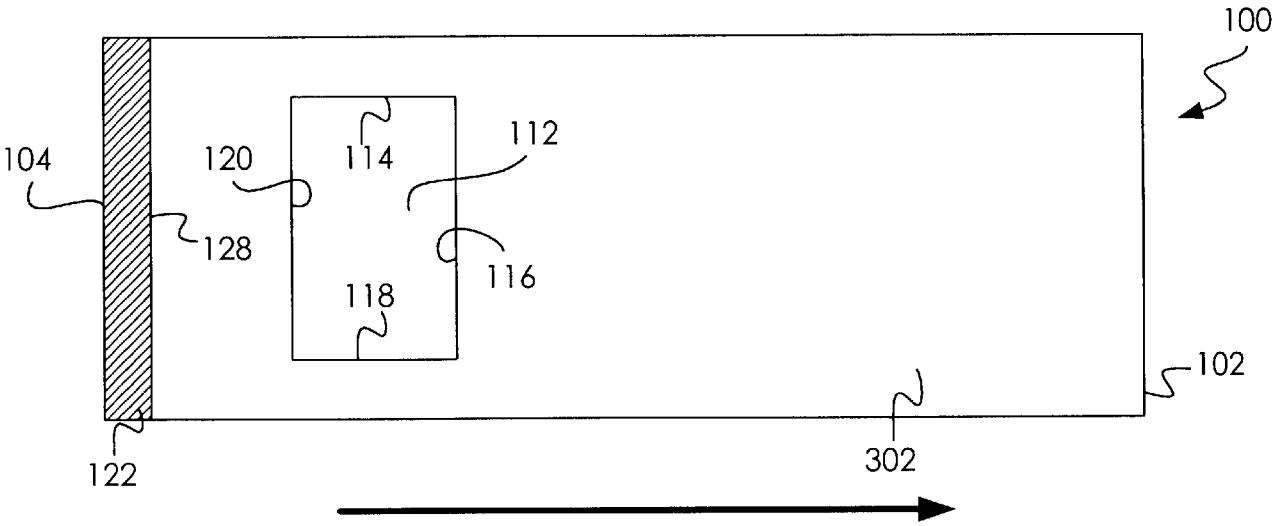
FIG. 3 is a plan view of a rear surface of the outer label of FIG. 1.

FIG. 3 shows the backside of the outer label 100. Leading end 102 and trailing end 104 are seen in this figure as well. Transparent portion 112 and the edges 114, 116, 118, and 120 of the transparent portion 112 are also seen in FIG. 3. A strip of adhesive 122 is shown as being disposed on a rear surface 302 of the outer label 100 adjacent to the trailing end 104 and is further defined by edge 128. Advantageously, with the exception of the strip of adhesive 122, the rear surface 302 of outer label 100 is substantially non-adhesive. As is discussed in more detail below, adhesive strip 122 secures the trailing end 104 of the outer label 100 to the leading end 102 when it is mounted over the inner label 200 (FIG. 2). It is also seen in FIG. 3, as it was in FIG. 1, that outer label 100 is slightly longer than the inner label 200, so that the adhesive edge or strip 122 has enough room, as the outer label 100 is wrapped around the container, to adhere to the leading end 102 of outer label 100, to rotatably affix the outer label 100 about the container. Similarly, as was explained above in FIG. 1, FIG. 3 has no release tabs or perforations, as was evident in the previous related patent applications.

Figure 4:
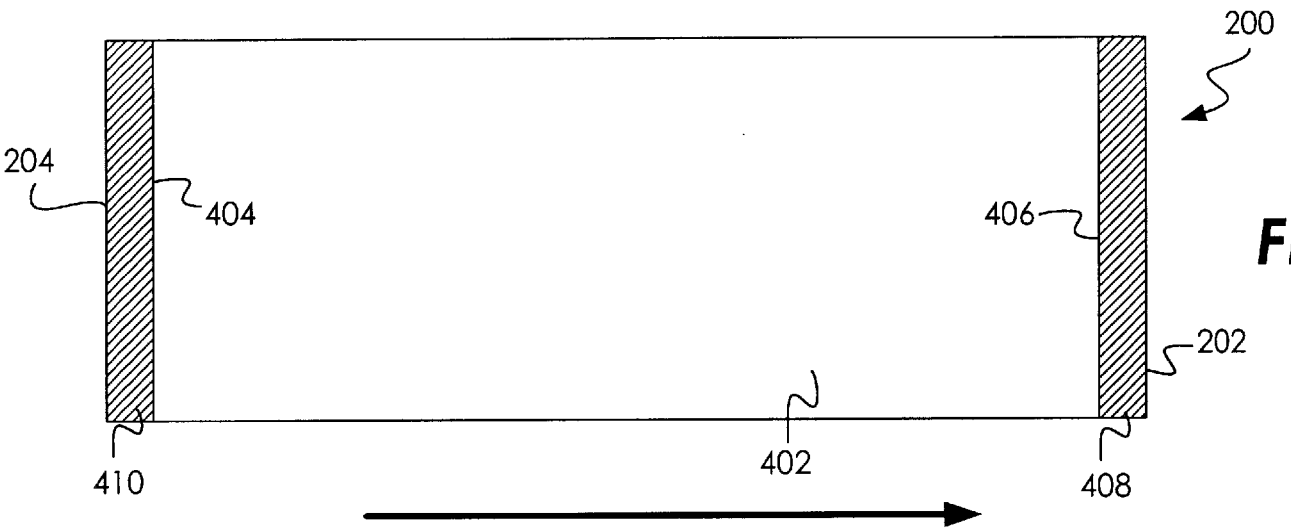
FIG. 4 is a plan view of a rear surface of the inner label of FIG. 2.

FIG. 4 illustrates a rear surface 402 of the inner label 200. The rear surface 402 has two strips of adhesive 408 and 410 immediately adjacent the leading and trailing ends, 202 and 204, respectively. Adhesive strip 408 has an edge 406 defined as its limit on the inner label 200, and adhesive strip 410 has its defining edge 404, as well. As set forth above, inner label 200 is usually narrower than outer label 100 so that the edges of inner label 200 are not visible above or below the upper and lower edges of outer label 100. Outer label 100 is longer than inner label 200 so that trailing end 104 of inner label 100 can be attached to leading end 102 by the use of adhesive strip 122.

Figure 5A:
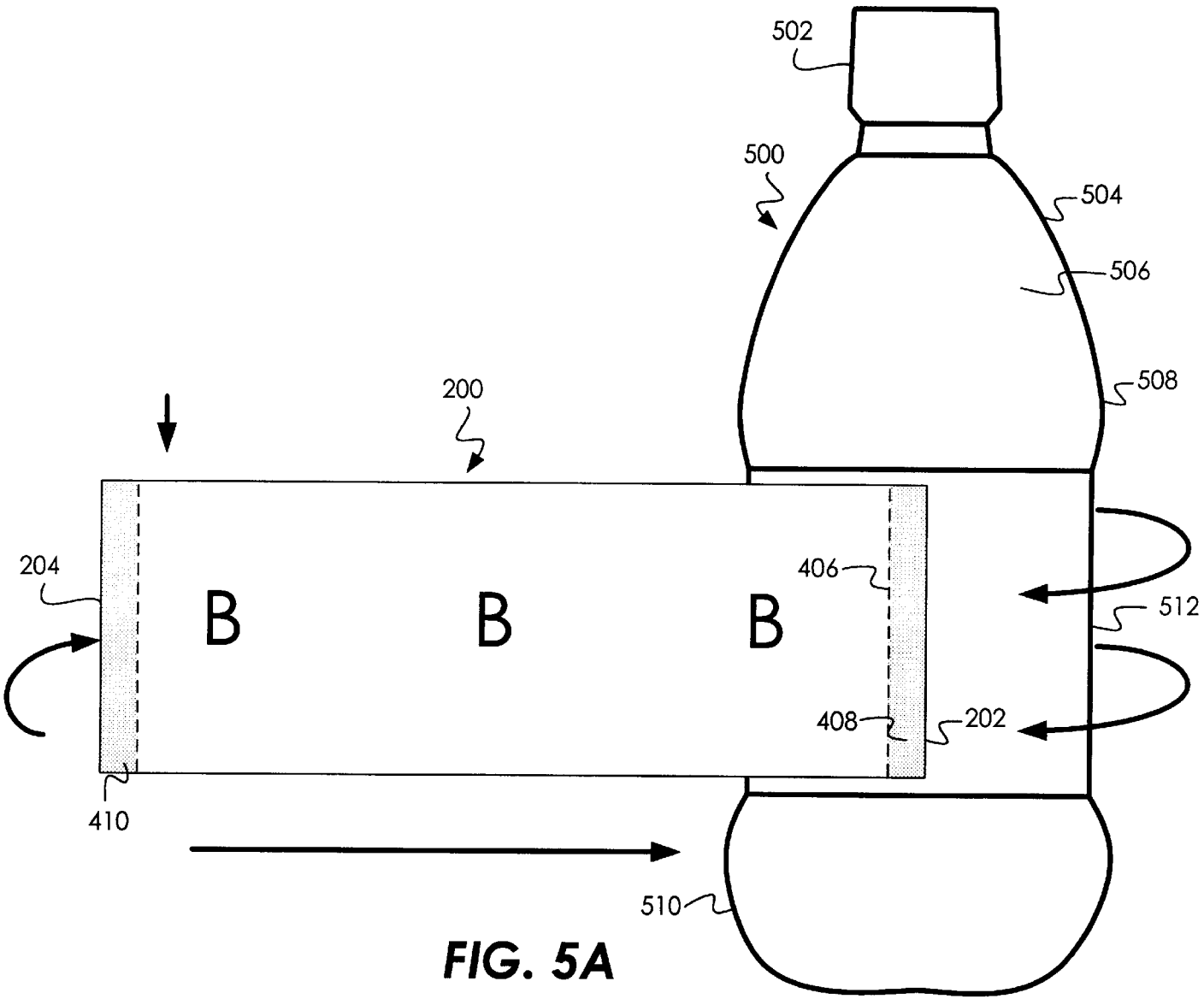
FIG. 5*a* illustrates the inner label of FIG. 4 partially wrapped about a container in accordance with the present invention.

FIG. 5*a* illustrates the application of the inner label 100 to a container 500. Such a container could be a glass or plastic bottle, or other type of container such as a metal can or cardboard receptacle. FIG. 5*a* shows the container 500 as having a cap 502 to be removably secured to a body 504. The body 504 has an exterior surface 506 that includes a top label panel 508, a bottom label panel 510, and a recessed surface 512 interposed between the top label panel 508 and bottom label panel 510. As discussed below, the inner label 200 is applied to container 500 at recessed area 512 between the top label panel 508 and a bottom label panel 510.

After the outer label 100 and inner label 200 are secured about the container 500, the top and bottom label panels 508, 510 limit the longitudinal displacement of the outer label 200 relative to the container 500. As will be seen below, limiting the longitudinal displacement of the outer label 100 on the container 500 prevents the outer label 100 from slipping off the container 500. Other label holding means are contemplated, such as rims, seams, ridges, etc.

For the embodiment in FIG. 5*a*, the length of label 200 is longer than the circumference of recessed surface 512 of container 500. That is, when inner label 200 is wrapped around the container 500, inner label 200 will, via rear adhesive strip 410, overlap and adhere to the leading end 202 of inner label 200. Adhesive strip 408 is utilized to initially adhere the inner label 200 to container 500. Adhesive surface strips 408 and 410 are shown in dotted line phantom view because the adhesive is actually on the reverse side of the inner label 200 and would not normally be seen in this view except in dotted line fashion.

Figure 5B:
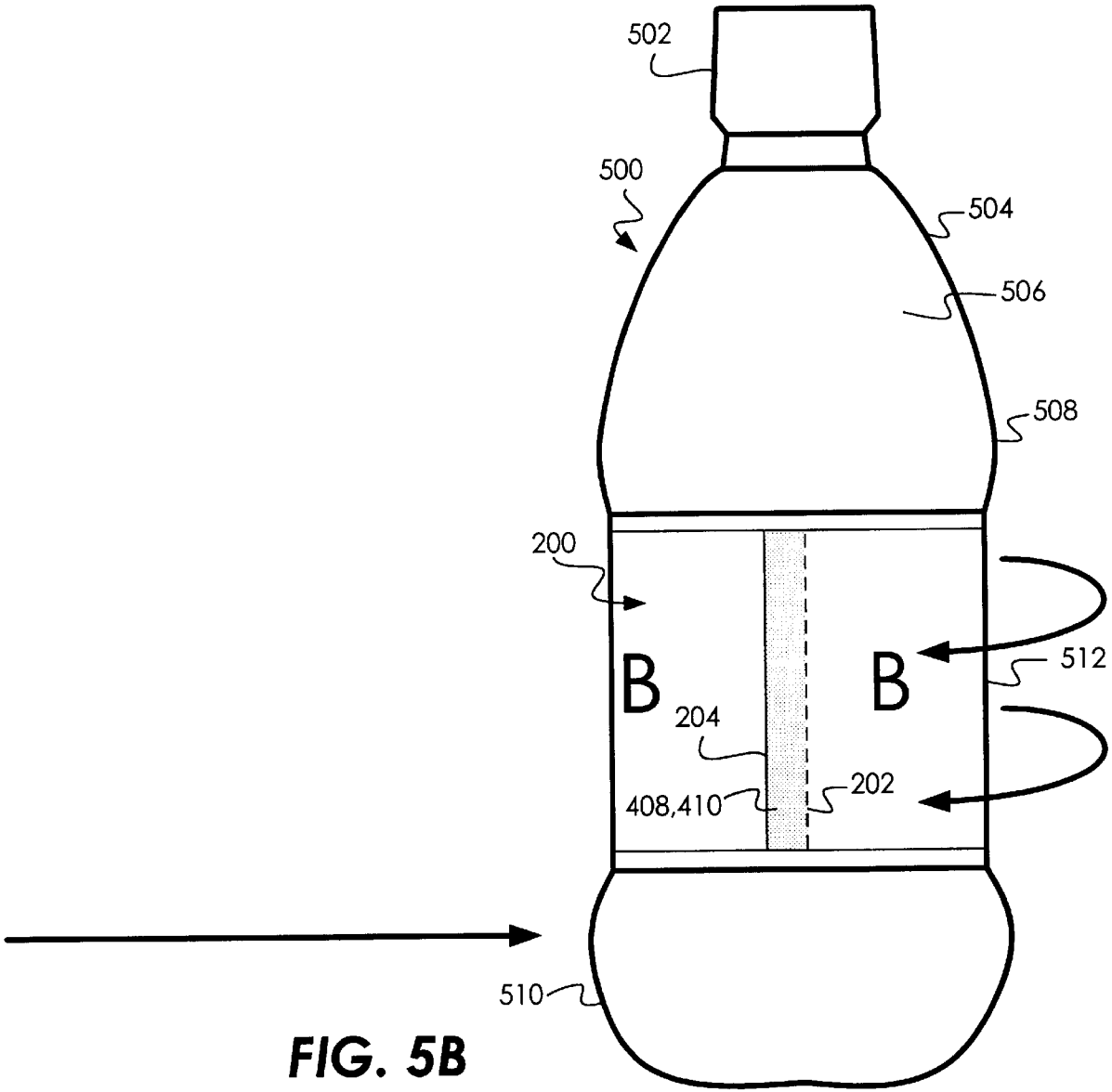
FIG. 5*b* illustrates the inner label of FIG. 4 secured about a container in accordance with the present invention.

FIG. 5*b* shows the container 500 with the inner label 200 mounted to the container 500. Initially, as seen in FIG. 5*a*, leading end 202 would be placed on the recessed surface 512 of container 500 and affixed to the container 500 by means of the adhesive 408. With relative motion between the container 500 and inner label 200, the inner label 200 would be wrapped around the container with trailing end 204 now overlapping leading end 202 such that adhesive 408 holds the leading end 202 to the container 500 while adhesive 410 holds the trailing end 204 to the overlapping leading end 202 of inner label 200.

Figure 6A:
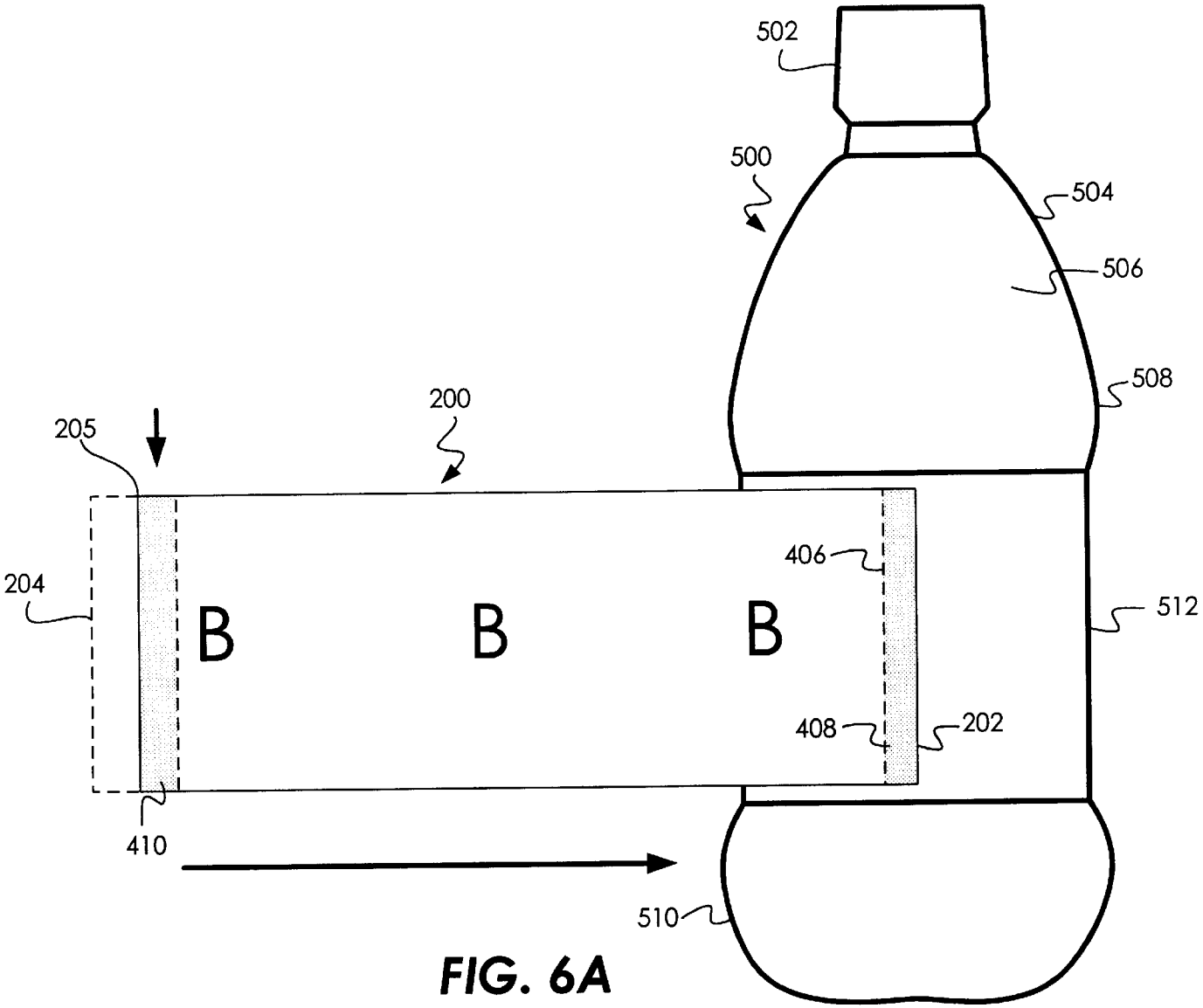
FIG. 6*a* illustrates a shorter inner label of FIG. 4 partially wrapped about a container in accordance with the present invention.

FIG. 6*a* is similar to the embodiment shown in FIG. 5*a*. It shows container 500 with the removable cap 502 and container body 504 which includes exterior surface 506, including top label panel 508, bottom label panel 510, and a recessed surface 152 in between the top label panel 508 and the bottom label panel 510. Inner label 200 is also shown in the same position for mounting on the recessed surface 512 of container 500 with leading end 202, leading adhesive strip 408, trailing adhesive strip 410, and shortened trailing end 205 of inner label 200. The shorter trailing end 205 allows for inner label 200 to be the exact length equaling the circumference of recessed surface 512 of container 500. Since the length of inner label 200 and the circumference of container 500 at its recessed surface 512 are equal, the inner label 200, when wrapped around the recessed surface 512, will not overlap but leading end 202 and trailing end 205 will abut together. The original length, as described in conjunction with FIG. 5*a*, is now shown with its trailing end 204 in dotted line fashion to illustrate the shortening of the inner label 200 to shorter trailing end 205. As in FIG. 5*a*, adhesive 408 and 410 are shown in phantom dotted line fashion because the adhesive is actually on the rear side not seen in this figure.

Figure 6B:
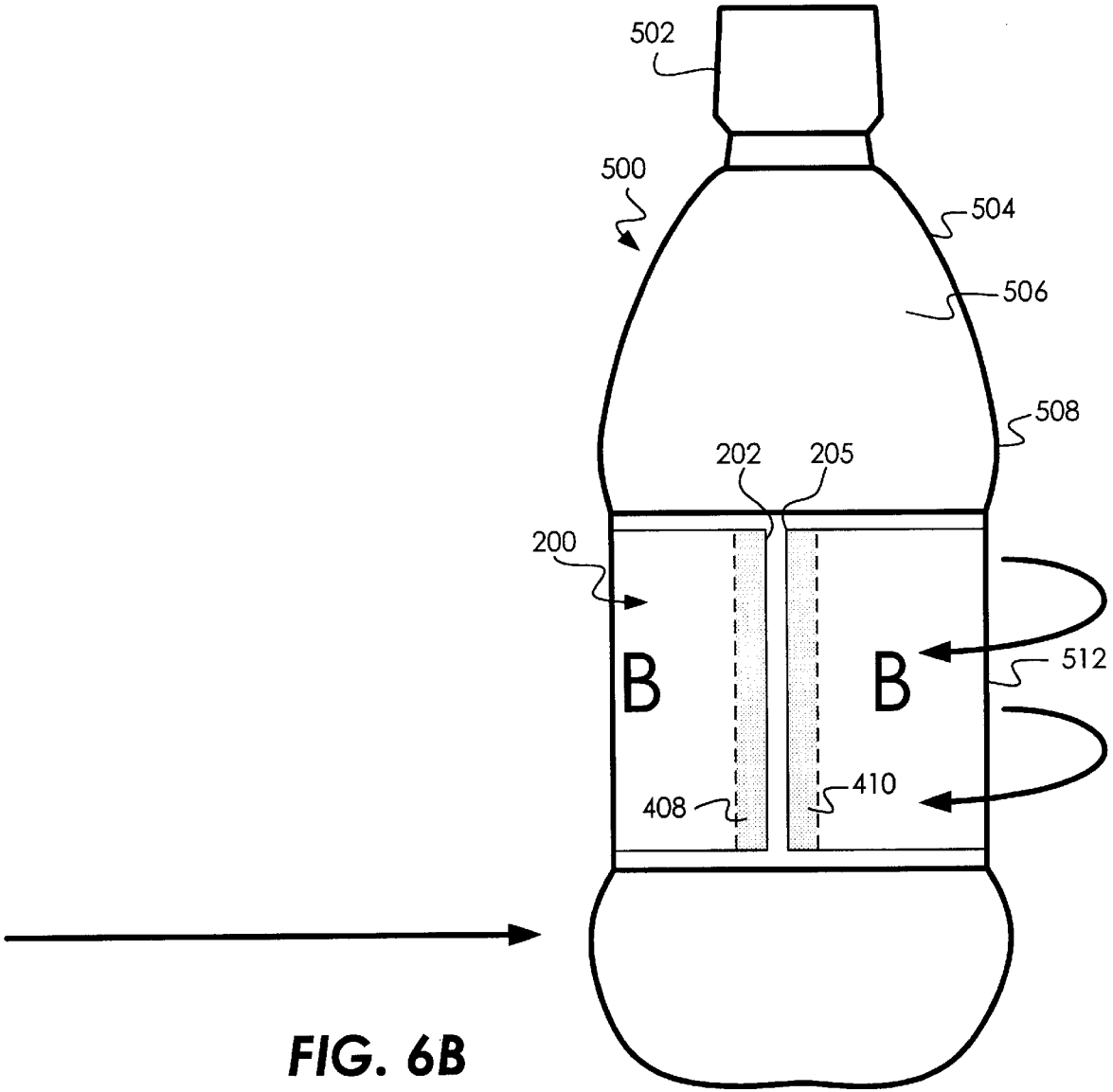
FIG. 6*b* illustrates a shorter inner label of FIG. 4 secured about a container in accordance with the present invention.

FIG. 6*b* shows the inner label 200 wrapped around the bottle or container 500. As set forth above, the length of the inner label 200 could be the length of the circumference of the recessed surface 512 of container 500, which would allow leading end 202 and shorter trailing end 205 to abut one another. However, it is also possible that inner label 200 could be shorter than the circumference of recessed surface 512 of container 500 which would provide for a gap between leading end 202 and trailing end 205 of inner label 200. In this instance, adhesive 408 on leading end 202 would adhere to exterior surface 506 as does adhesive 410 on shorter trailing end 205.

Figure 7A:
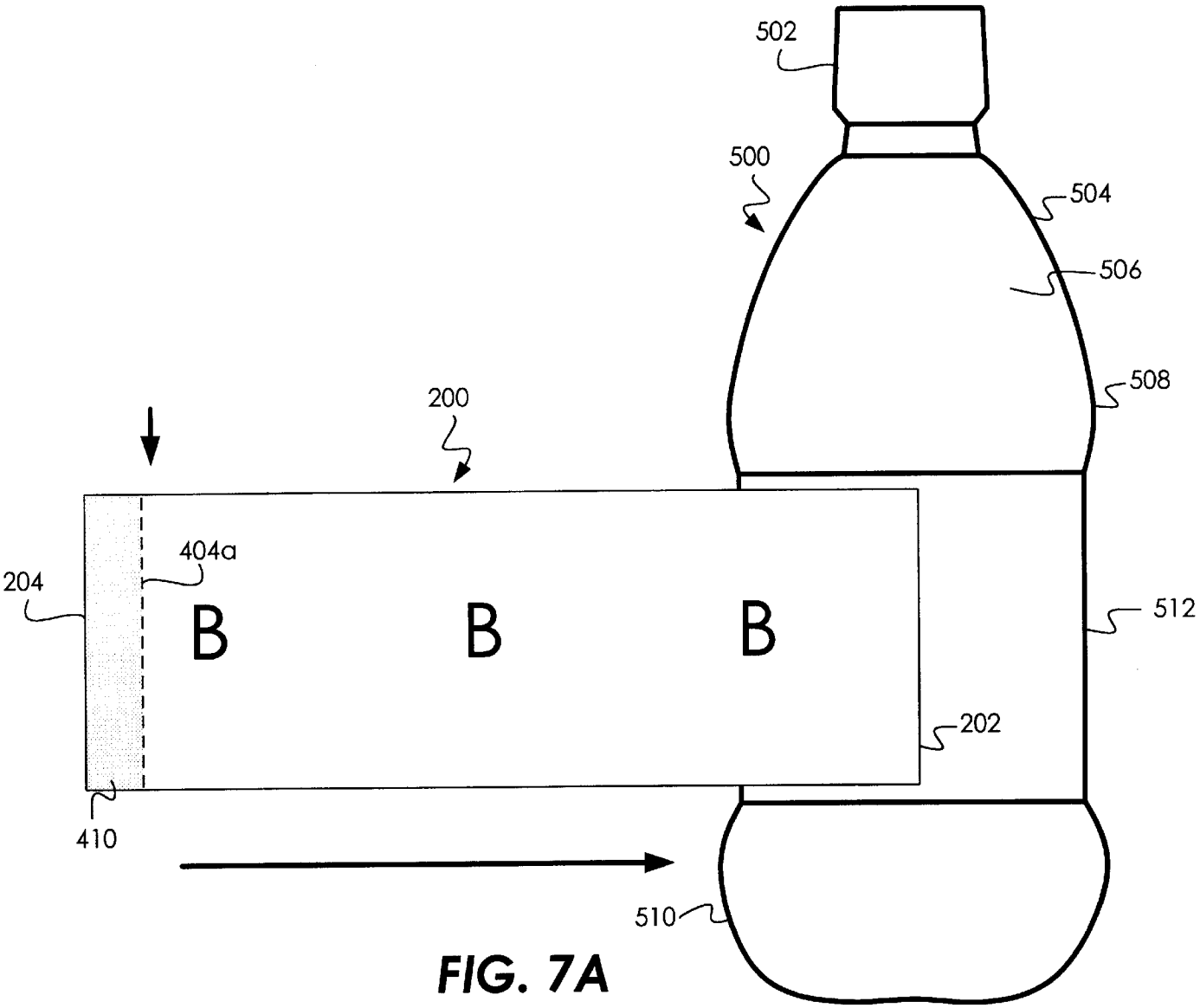
FIG. 7*a* illustrates the inner label of FIG. 4 with a wider adhesive strip partially wrapped about a container in accordance with the present invention.

FIG. 7*a* is similar to that of FIG. 6*a* with the container 500 and its similar sections and inner label 200 in place for mounting to the container 500. In this figure, however, inner label 200 does not have a forward edge adhesive with which to hold the leading end 202 in place while the inner label 200 is wrapped around the recessed surface 512 of container 500, as was shown in previous figures. However, the trailing end 204 now has a strip of adhesive larger (wider) than the previous strips of adhesive so that when inner label 200 is wrapped around the recessed surface 512 of container 500, the label section defined between trailing end 204 and edge 404*a* will contact and adhere to the leading end 202 of inner label 200 as well as contacting recessed surface 512 of container 500.

In this embodiment, extraneous means could be used to hold the leading end 202 of the inner label 200 to the container 500. For example, a blast of air or other gas against the leading end 202 could be used to hold the leading end 202 against the container 500 until the inner label 200 is wrapped completely around the recessed surface 512 of the container 500 and adhesive 410 can be used to affix the inner label 200 to the container 500. Moisture, such as a small amount of water, could be used to temporarily affix the leading end 202 of the inner label 200 to the container 500 until the entire inner label 200 is wrapped about the container 500. Of course, the moisture will quickly evaporate leaving no evidence of its use. Alternatively, a hold or pressing apparatus could be used in the wrapping mechanism itself to hold the inner label 200 in place until the inner label 200 is completely wrapped about the container 500. Further techniques could include supplying a vacuum pressure, or a static electric charge pressure to the inner label 200. Similar techniques may be used to apply the outer label loo about the inner label 200.

Figure 7B:
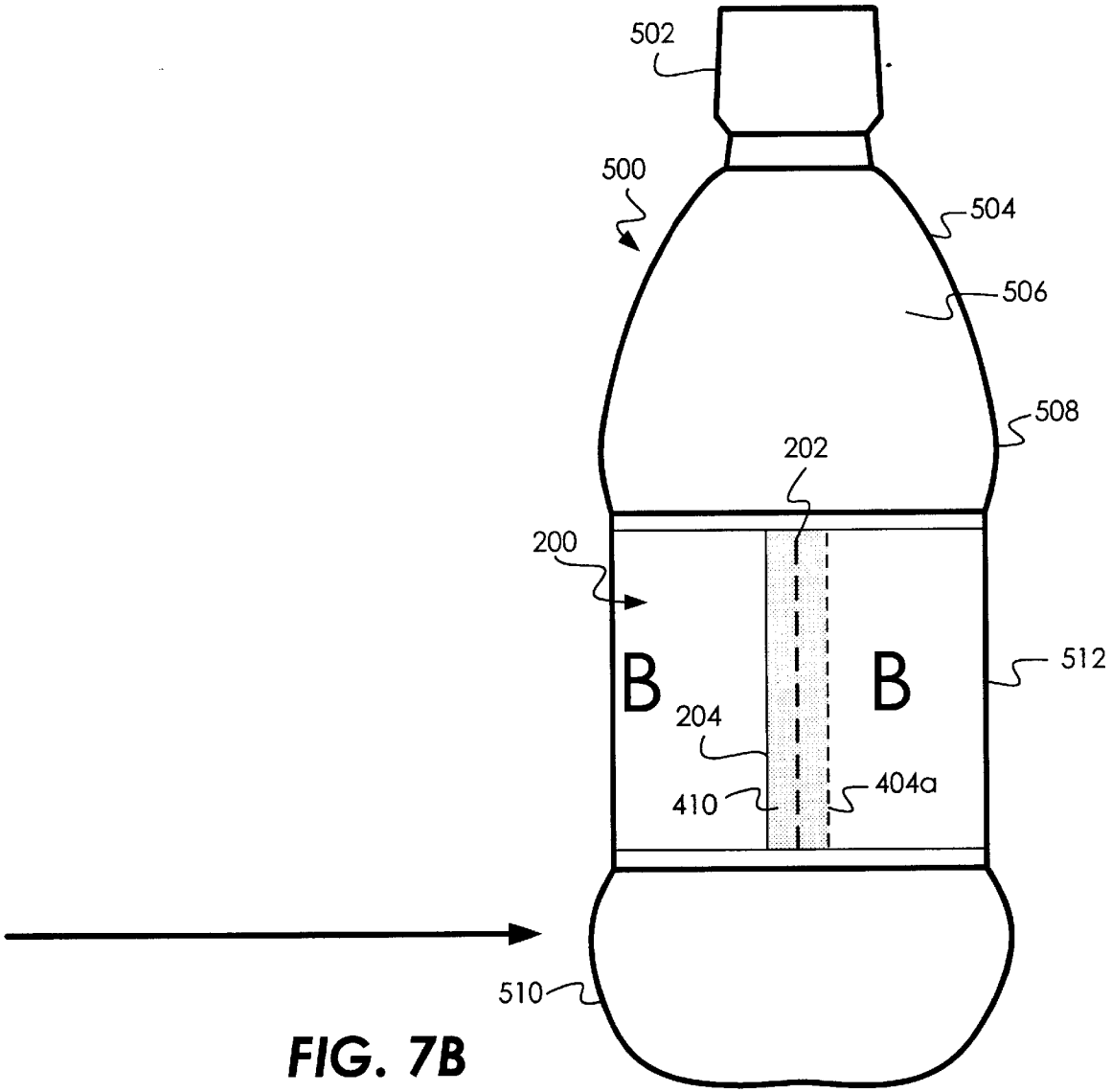
FIG. 7*b* illustrates the inner label of FIG. 4 secured about a container in accordance with the present invention.

FIG. 7*b* shows the container 500 with an overlapping inner label 200 where the adhesive strip 204 on the trailing end 204 is wider than the overlapping section of inner label 200 such that the adhesive 410 contacts not only the outer edge of the leading end 202 of inner label 200 but also contacts recessed surface 512 of container 500. In the previous figures, when the leading end 202 overlaps the trailing end 204 with the adhesive only contacting the leading end 202 of the inner label 200, such as in FIG. 5*b*, it is possible for inner label 200 to move with respect to the surface of container 500. This is undesirable in some instances; and the embodiment shown in FIG. 7*b* is provided so that once the inner label 200 is mounted to the container 500, the adhesive strip portion 410 which is wider than the overlapping sections of the inner label 200 which allows the inner label 200 to be fixedly mounted to the bottle or container 500. The adhesive on the trailing end 204 contacts the surface of the container 500 and prevents the inner label 200 from moving circumferentially around the container 500.

Figure 8:
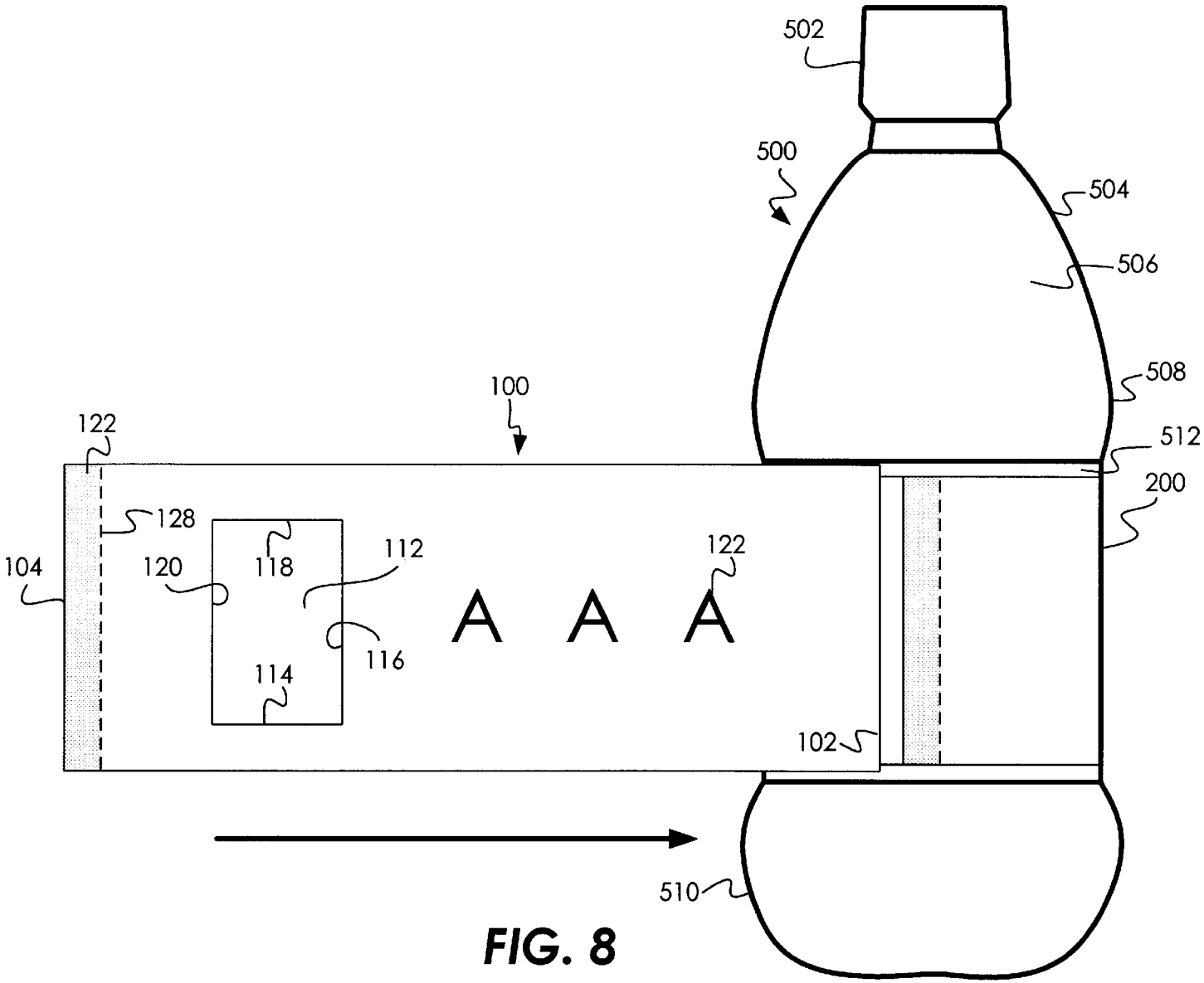
FIG. 8 illustrates the outer label of FIG. 3 partially wrapped about a container in accordance with the present invention.

FIG. 8 shows container 500 with the inner label 200 already mounted to the recessed surface 512 of container 500. At this point it is desirable to mount the outer label 100 over the inner label 200 on container 500. It is clearly shown in this figure that outer label 100 is wider than inner label 200 so that if there is any slight longitudinal movement of the outer label 100 within the recessed surface 512, none of the inner label 200 will be viewable by a user or consumer of the contents of container 500. Outer label 100 is the label seen and described above in reference to FIG. 3. That is, outer label 100 has a leading or front end 102 and a trailing or second end 104. There is a transparent portion 112 defined by edges 114, 116, 118, and 120. Also shown is adhesive strip 122 illustrated in dotted or dashed phantom line because the adhesive is actually on the rear, nonviewable, surface of outer label 100.

As described in more detail in connection with FIG. 7*a*, various techniques may be used to temporarily attach the leading end 102 of outer label 100 to the inner label 200 or container 500. Such techniques include a blast of air of gas against the leading end 102, moisture applied to the leading end, vacuum pressure, and static electric charge pressure. Other methods for temporarily positioning the leading end 102 may also be used.

When there is relative motion between the container 500 and the outer label 100, outer label 100 will wrap around the recessed surface 512 of container 500. By relative motion, it is meant that the outer label 100 is maintained stationary and the container 500 is rotated along a line in order to wrap the outer label 100 about the container 500. Alternatively, the container 500 may remain stationary and the outer label 100, by manufacturing means known in the art, wraps around the recessed surface 512 of container 500. Yet another embodiment may be a combination of the two above-described motions. Similar methods may be used to apply the inner label 200.

Once the outer label 100 is completely wrapped about the container 500, the adhesive 122 on the trailing end 104 will contact and form a bond with the front surface of the leading end 102. Because the trailing end 104 overlaps the leading end 102 of the outer label 100, the adhesive 122 will not contact the inner label 200 or the container 500. By having the trailing end 104 only adhering to the leading end 102, the outer label 100 is free to rotate about the inner label 200 and the container 500 once the temporary coupling is removed.

Figure 9:
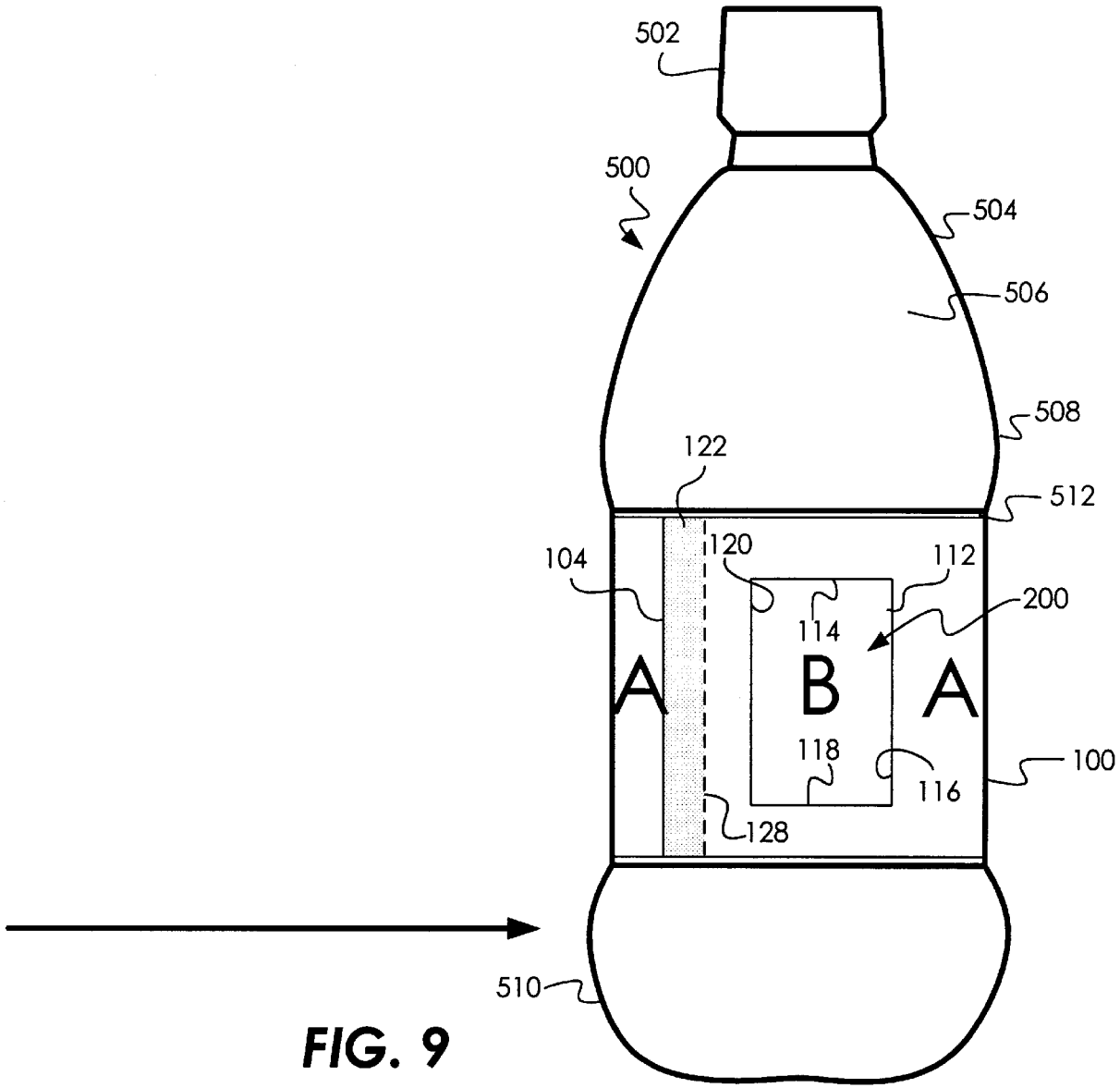
FIG. 9 illustrates the outer label of FIG. 3 secured about a container in accordance with the present invention.

FIG. 9 shows outer label 100 disposed around the center recessed surface 512 of container 500 with the adhesive 122 on trailing end 104 adhering to the leading end 102 (not shown in this figure); thus positioning the outer label 100 about the inner label 200. In this figure, for the first time, one can see the relationship between the inner label 200 and the outer label 100. With the inner label 200 affixed to the container 500, and the outer label 100 movably disposed about the inner label 100 but allowed to move circumferentially about the inner label 100 along the recessed surface 512, the transparent portion 112 in the outer label 100 allows any writing or other indicia on the inner label 200 to be seen through the transparent portion 112 of outer label 100. As the outer label 100 is rotated about an axis of the container 500, different portions of the underlying label 200 come into view through the transparent portion 112 of outer label 100.

Figure 10:
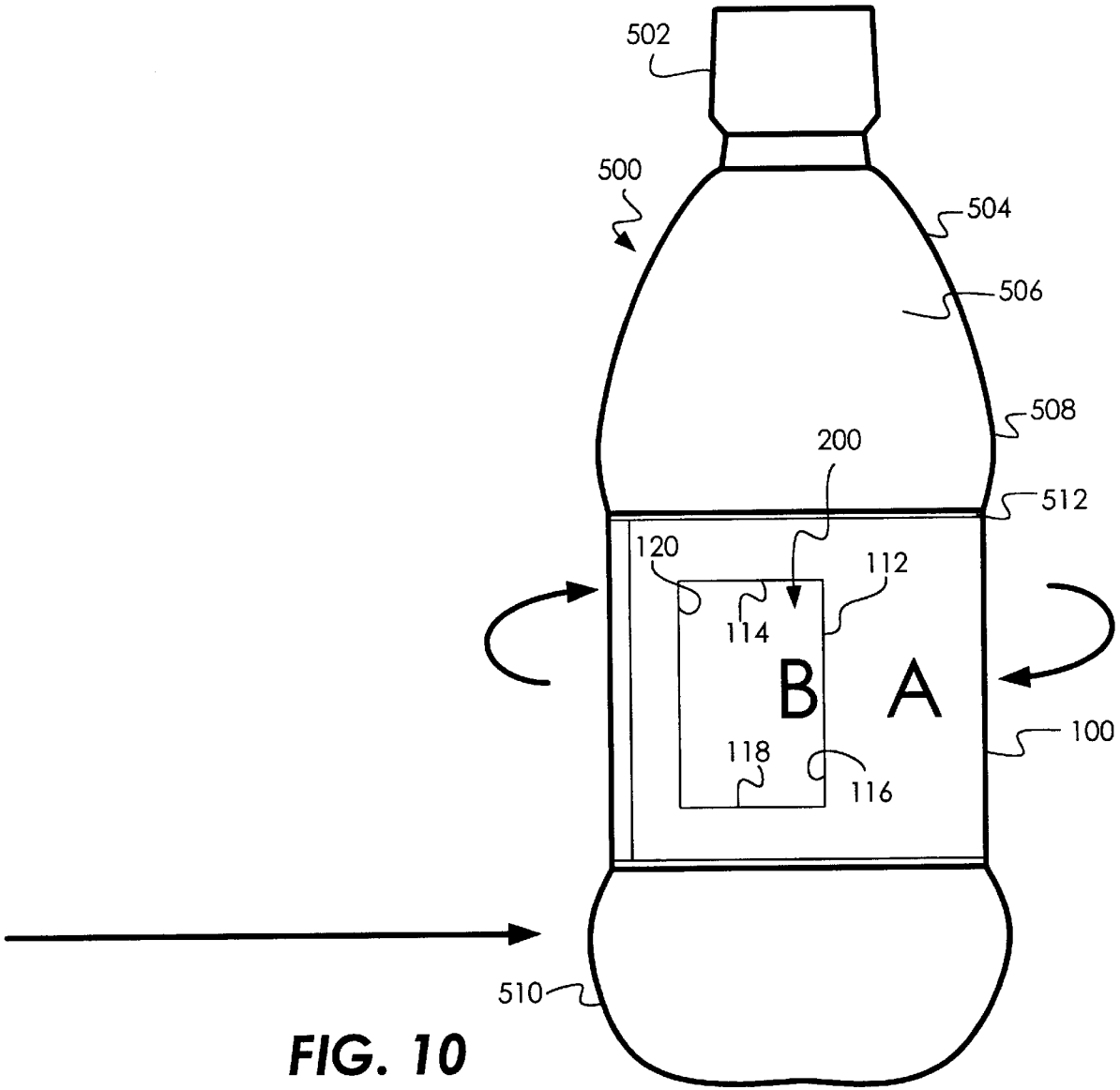
FIG. 10 illustrates the outer label beginning to be rotated about the circumference of the container over the inner label.

The motion of the outer label 100 is seen now in FIG. 10. If the outer label 100 is moved in a clockwise direction as viewed from the top of container 500, then the right edge 116 of outer label 100 will begin to eclipse the writing underneath as shown by the clipping of the right edge 116 of the letter 'B', which is representative of the information printed on the inner label 200. Of course, the outer label loo may also be moved in a counter clockwise direction as viewed from the top of container 500, at the choice of the consumer or user of the container 500.

Figure 11:
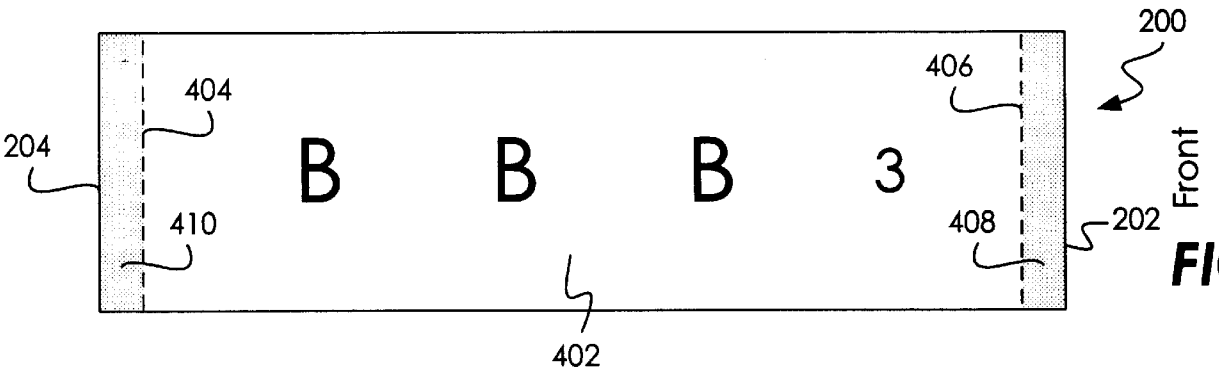
FIGS. 11, 12, and 13 depict three embodiments of inner labels in accordance with the invention.
Figure 12:
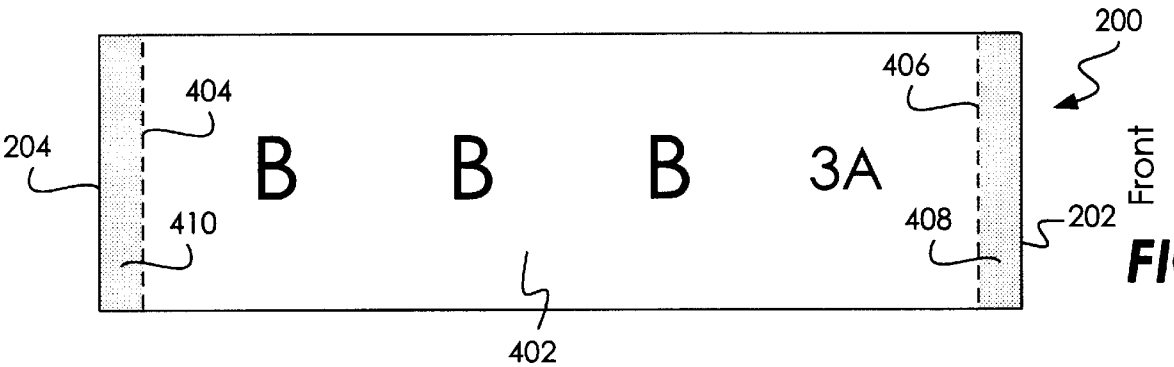
Figure 13:
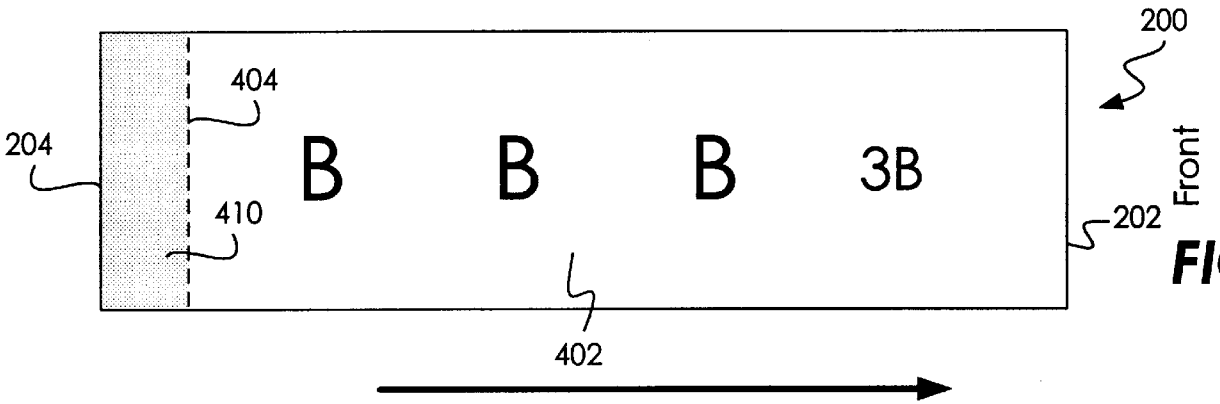

In FIGS. 11, 12, and 13 are rear surface views of the various inner labels as previously described in conjunction with the drawings. FIG. 11 shows inner label 200 with leading end 202 and trailing end 204 with adhesive 408 adjacent to the leading end 202, and adhesive 410 adjacent trailing or second end 204. FIG. 12 shows the same label 200 except that it is slightly shorter and is used in conjunction with the embodiment as shown in FIG. 6*b* as described above. FIG. 13 shows inner label 200 with the extra wider adhesive 410 for use in the overlapping embodiment of the inner label 200 as shown and described in conjunction with FIG. 7*b*.

Figure 14:
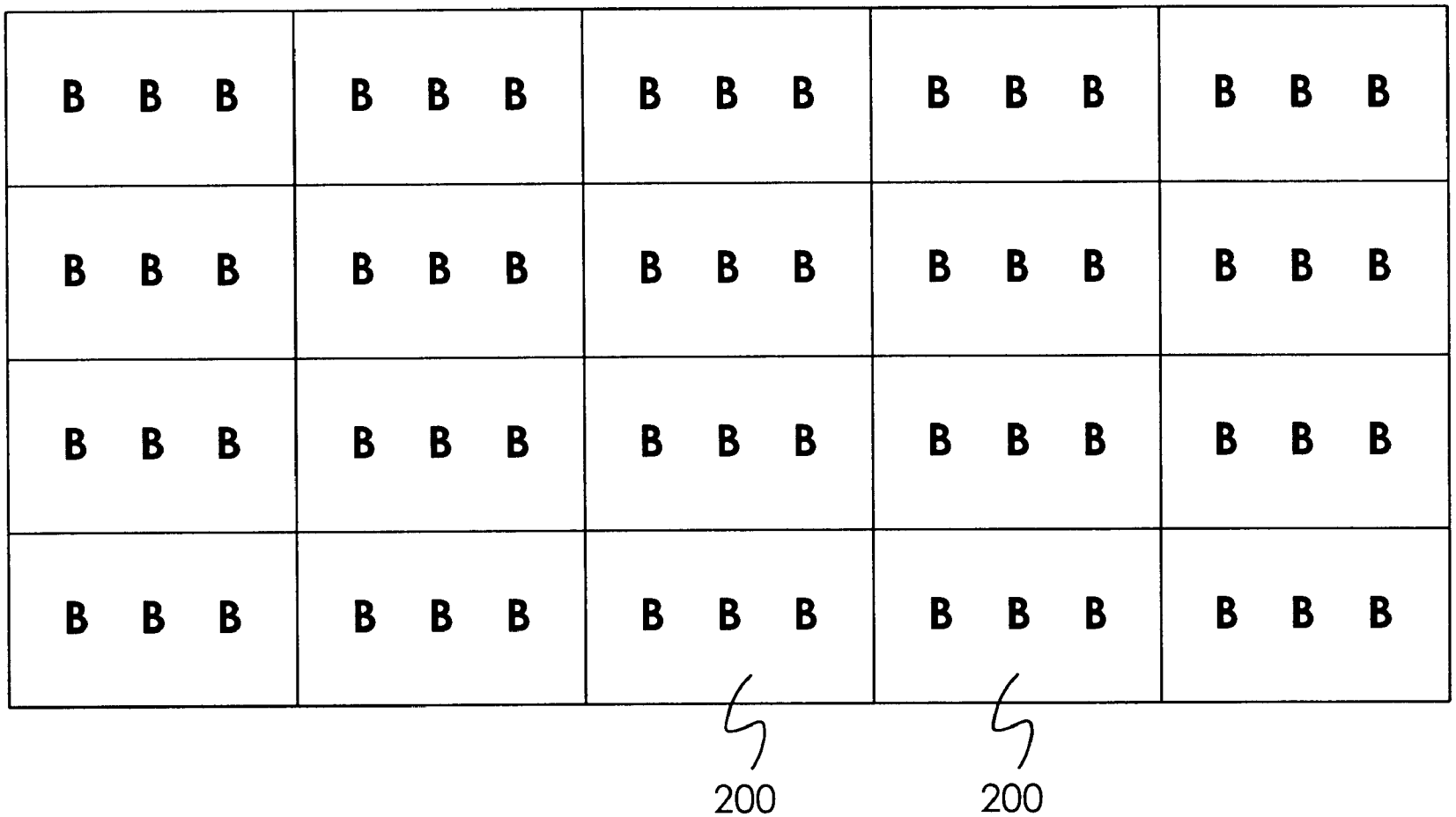
FIG. 14 is a plan view of inner labels being manufactured prior to cutting into strips of individual inner labels.

FIG. 14 illustrates one embodiment of a plurality of inner labels 200 being manufactured. Shown in FIG. 14 are four rows of inner labels 200 laterally adjacent one another. The length of the material upon which the inner labels 200 are printed depends upon how much material is available and the complexity and capacity of the manufacturing apparatus itself. The printed material shown schematically as the letters 'B' on FIG. 14 could be printed by any method; but a typical method of printing could utilize the Flexography method of printing, as is well known in the art. The material itself could comprise biaxially oriented polypropylene, well-known as BOPP. The inner labels 200 would have the length or distance as determined by whether the apparatus is manufacturing labels set forth in FIGS. 11, 12, or 13, with concomitant lengths thereof.

Figure 15:
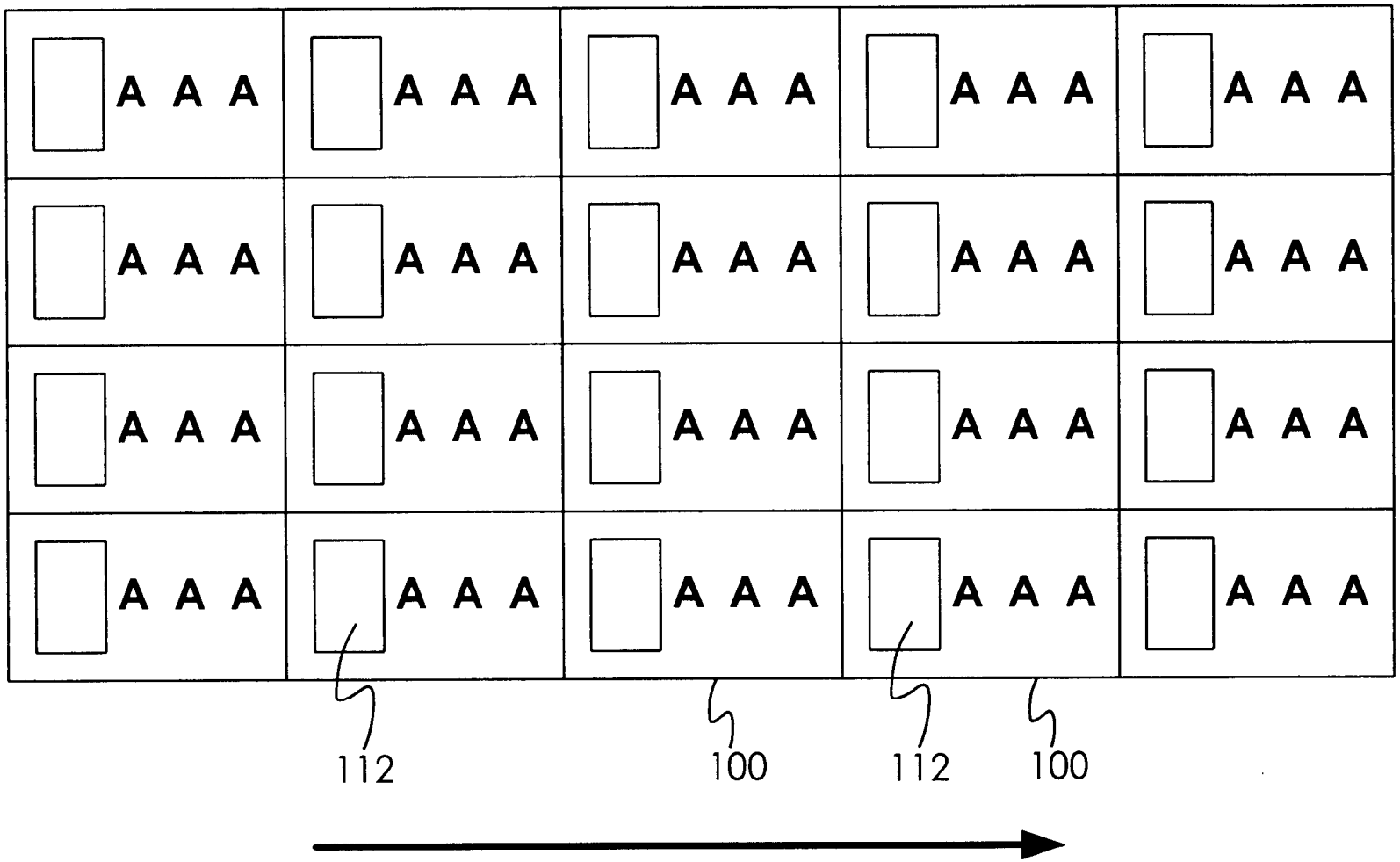
FIG. 15 is a plan view of outer labels being manufactured prior to cutting into strips of individual outer labels.

FIG. 15 shows the makeup of the material used to make the outer labels 100 with the leading and trailing ends and appropriate adhesives depending upon the embodiment shown and to be manufactured. Also shown in FIG. 15 are transparent portions 112 in the outer labels 100 use for viewing the printed material on the inner labels 200 such as the letters 'B' as shown and described above in conjunction with FIG. 14. As set forth above, the transparent portion 112 of outer label 100 could be an actual opening cut into the material or an area left transparent depending upon how the remaining part of the labels are printed and developed utilizing, for example, the Flexography technique. Similar to inner labels 200 in FIG. 11, the outer labels 100 could also be made of biaxially oriented polypropylene, well known as BOPP.

Figure 16:
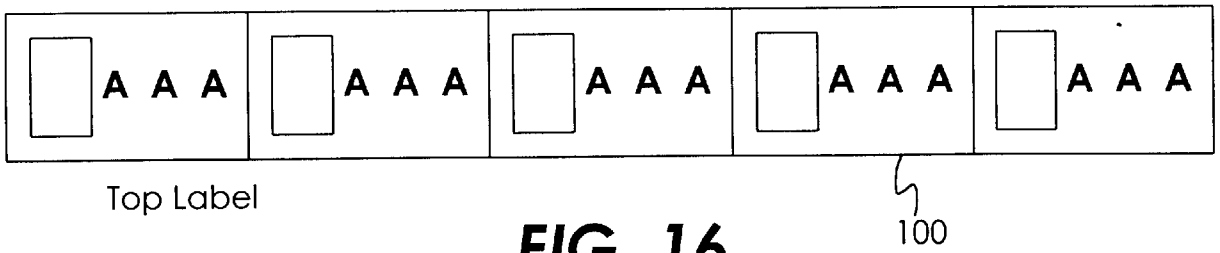
FIG. 16 is a plan view of a strip of outer labels of FIG. 15.
Figure 17:
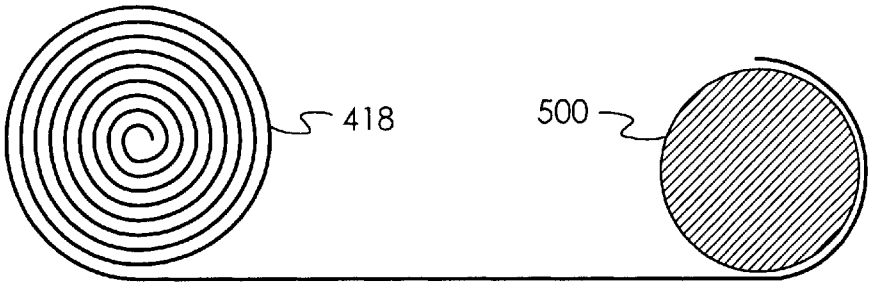
FIG. 17 is a schematic side view of inner or outer labels partially wrapped about the circumference of a container.
Figure 18:
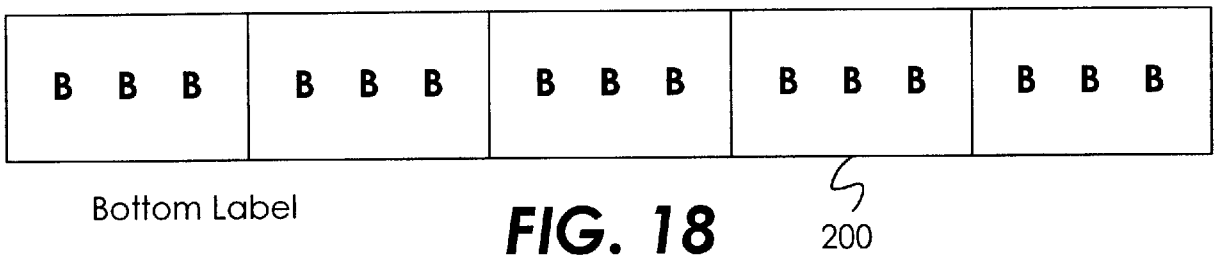
FIG. 18 is a plan view of a strip of inner labels of FIG. 14 in accordance with the invention.

FIG. 16 shows a length of outer labels 100 after manufacturing as in FIG. 12 and cut to width. This allows the outer labels 100 to be rolled up as in FIG. 17 which shows roll 415 with a length of outer label 100 beginning to be wrapped around a container 500. FIG. 18 shows a similar cut length of inner labels 200 and could be rolled similar to the outer label roll 415 shown in FIG. 17.

The invention has been described above with references to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. A method of applying a rotatable label to an object, comprising the steps of:

providing an object;

attaching an inner label with indicia disposed thereon about the object;

temporarily coupling a leading end of an outer label having indicia and a transparent portion disposed thereon to the inner label while the outer label is wrapped about the object;

securing the outer label about the object; and uncoupling the leading end of the outer label to permit the outer label to rotate about the inner label and the object.

2. The method according to claim 1, wherein the step of temporarily coupling further comprises adhering a small amount of liquid disposed on a rear surface of the outer label to a front surface of the inner label.

3. The method according to claim 1, wherein the step of uncoupling the leading end further comprises rotating the outer label relative to the inner label.

4. The method according to claim 1 wherein the step of attaching an inner label further comprises temporarily coupling a leading end of the inner label to the object while the inner label is wrapped around the object and affixed to the object by adhesive on a trailing end.

5. The method according to claim 1, wherein the step of temporarily coupling further comprises applying an external physical pressure to the outer label.

6. The method according to claim 1, wherein the step of temporarily coupling further comprises applying a vacuum pressure to the outer label.

7. The method according to claim 1, wherein the step of temporarily coupling further comprises applying a static electrostatic charge pressure to the outer label.

8. The method according to claim 1, wherein the step of temporarily coupling further comprises applying an external gaseous pressure to the outer label.

9. The method according to claim 1, wherein the step of providing an object further includes providing top and bottom label panels on the object, the inner and outer labels being disposed about the object between the top and bottom label panels.

10. The method according to claim 1, wherein the step of attaching further comprises the step of providing an adhesive to a rear surface of the inner label to allow the inner label to be affixed to the object.

11. The method according to claim 10, wherein the step of providing an adhesive further comprises applying the adhesive to a leading and a trailing end of the inner label so that both ends are in adhering contact with the object.

12. The method according to claim 10, wherein the step of providing an adhesive further comprises applying the adhesive at a trailing end in a strip wider than an overlapping portion of the inner label so that the trailing end contacts both a leading end of the inner label and the object when the inner label is wrapped about the object.

13. The method according to claim 1, wherein the step of securing further comprises providing adhesive only to a trailing end of the outer label so that the trailing end overlaps and adheres to a leading end to rotatably attach the outer label about the object.

14. The method according to claim 1, wherein the steps of attaching and securing are performed by holding the object stationary and wrapping the inner and outer labels around the object.

15. The method according to claim 1, wherein the step of attaching and securing are respectively performed by holding the inner and outer labels stationary and rolling the object within the inner and outer labels.

16. A roll-fed method for applying a rotatable label system to an object, comprising the steps of:

providing an object;

providing a roll of inner labels having indicia disposed thereon;

feeding an inner label from the roll of inner labels to the object;

attaching the inner label about the object;

providing a roll of outer labels having indicia and a transparent portion disposed thereon;

feeding an outer label from the roll of outer labels to the object;

temporarily coupling a leading end of the outer label to the inner label;

securing the outer label to the object; and uncoupling the leading end of the outer label to permit the outer label to rotate about the inner label and the object.

17. The method according to claim 16 wherein the step of attaching an inner label further comprises temporarily coupling a leading end of the inner label to the object while the inner label is wrapped around the object and affixed to the object by adhesive on a trailing end of the inner label.

18. The method according to claim 16, wherein the step of temporarily coupling further comprises applying an external physical pressure to the outer label.

19. The method according to claim 16, wherein the step of temporarily coupling further comprises applying a vacuum pressure to the outer label.

20. The method according to claim 16, wherein the step of temporarily coupling further comprises applying a static electrostatic charge pressure to the outer label.

21. The method according to claim 16, wherein the step of temporarily coupling further comprises applying an external gaseous pressure to the outer label.

22. The method according to claim 16, wherein the step of providing an object further includes providing top and bottom label panels on the object, the inner and outer labels being disposed about the object between the top and bottom label panels.

23. The method according to claim 16, wherein the step of attaching further comprises the step of providing an adhesive to a rear surface of the inner label to allow the inner label to be affixed to the object.

24. The method according to claim 23, wherein the step of providing an adhesive further comprises applying the adhesive to a leading and a trailing end of the inner label so that both ends are in adhering contact with the object.

25. The method according to claim 23, wherein the step of providing an adhesive further comprises applying the adhesive at a trailing end in a strip wider than an overlapping portion of the inner label so that the trailing end contacts both a leading end of the inner label and the object when the inner label is wrapped about the object.

26. The method according to claim 16, wherein the step of securing further comprises providing adhesive only to a trailing end of the outer label so that the trailing end overlaps and adheres to a leading end to rotatably attach the outer label about the object.

27. The method according to claim 16, further comprising the step of holding the object stationary while wrapping the inner and outer labels around the object.

28. A roll-fed method for applying a rotatable label system to an object, comprising the steps of:

providing the object;

providing a roll of inner labels having indicia disposed thereon;

feeding an inner label from the roll of inner labels to the object;

attaching the inner label to the object by holding the inner label stationary and rolling the object along the inner label;

providing a roll of outer labels having indicia and a transparent portion thereon;

feeding an outer label from the roll of outer labels to the object;

temporarily coupling a leading end of an outer label to the inner label; and securing the outer label about the object by holding the outer label stationary and rolling the object along the outer label; and uncoupling the leading end of the outer label to permit the outer label to rotate about the inner label and the object.

29. The method according to claim 28 wherein the step of attaching further comprises temporarily coupling a leading end of the inner label to the object while the object is rolled along the inner label and affixed to the inner label by adhesive on a trailing end of the inner label.

30. The method according to claim 28, wherein the step of temporarily coupling further comprises applying an external physical pressure to the outer label.

31. The method according to claim 28, wherein the step of temporarily coupling further comprises applying a vacuum pressure to the outer label.

32. The method according to claim 28, wherein the step of temporarily coupling further comprises applying a static electrostatic charge pressure to the outer label.

33. The method according to claim 28, wherein the step of temporarily coupling further comprises applying an external gaseous pressure to the outer label.

34. The method according to claim 28, wherein the step of providing an object further includes providing top and bottom label panels on the object, the inner and outer labels being disposed about the object between the top and bottom label panels.

35. The method according to claim 28, wherein the step of attaching further comprises the step of providing an adhesive to a rear surface of the inner label to allow the inner label to be affixed to the object.

36. The method according to claim 35, wherein the step of providing an adhesive further comprises applying the adhesive to a leading and a trailing end of the inner label so that both ends are in adhering contact with the object.

37. The method according to claim 35, wherein the step of providing an adhesive further comprises applying the adhesive at a trailing end in a strip wider than an overlapping portion of the inner label so that the trailing end contacts both a leading end of the inner label and the object when the object is rolled along the inner label and affixed thereto.

38. The method according to claim 28, wherein the step of securing further comprises providing adhesive only to a trailing end of the outer label so that the trailing end overlaps and adheres to a leading end to rotatably attach the outer label about the object.

* * * * *